US009435279B2

(12) United States Patent
Iwazaki et al.

(10) Patent No.: US 9,435,279 B2
(45) Date of Patent: Sep. 6, 2016

(54) INTER-CYLINDER AIR-FUEL RATIO VARIATION ABNORMALITY DETECTION APPARATUS

(71) Applicants: Yasushi Iwazaki, Ebina (JP); Kenji Suzuki, Susono (JP)

(72) Inventors: Yasushi Iwazaki, Ebina (JP); Kenji Suzuki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 232 days.

(21) Appl. No.: 14/223,418

(22) Filed: Mar. 24, 2014

(65) Prior Publication Data

US 2014/0309907 A1 Oct. 16, 2014

(30) Foreign Application Priority Data

Apr. 16, 2013 (JP) ..... 2013-085953

(51) Int. Cl.
*F02D 41/00* (2006.01)
*F02D 41/14* (2006.01)

(52) U.S. Cl.
CPC ..... *F02D 41/1454* (2013.01); *F02D 41/0085* (2013.01)

(58) Field of Classification Search
CPC .. F02D 41/00; F02D 41/0085; F02D 41/008; F02D 41/0082
USPC ..... 701/103, 104
See application file for complete search history.

(56) References Cited

U.S. PATENT DOCUMENTS 6,789,534 B2 * 9/2004 Yasui ..... F02D 41/0085 123/494
6,990,402 B2 * 1/2006 Yasui ..... F02D 41/1402 123/674
7,051,725 B2 * 5/2006 Ikemoto ..... F02D 41/0032 123/673
7,146,851 B2 * 12/2006 Wakahara ..... F01L 1/34 73/114.72
7,356,985 B2 * 4/2008 Hirata ..... F02D 41/008 123/673
7,487,035 B2 * 2/2009 Nozawa ..... F02D 41/1438 123/198 F
7,681,565 B2 * 3/2010 Fujiki ..... F02D 41/008 123/673
7,707,822 B2 * 5/2010 Katoh ..... F02D 41/0085 60/274
7,950,269 B2 * 5/2011 Maeda ..... F02D 41/0025 73/114.45
8,103,430 B2 * 1/2012 Aliakbarzadeh .... F02D 41/0085 123/479
8,413,497 B2 * 4/2013 Kayama ..... F02D 41/22 73/114.72
2013/0124069 A1 * 5/2013 Hassdenteufel ..... F02D 41/00 701/104

FOREIGN PATENT DOCUMENTS

JP 2007113515 A 5/2007
JP 2012-202388 A 10/2012
JP 2012-237279 A 12/2012
JP 2013-007280 A 1/2013

* cited by examiner

*Primary Examiner* — Hai Huynh
*Assistant Examiner* — Raza Najmuddin
(74) *Attorney, Agent, or Firm* — Dinsmore & Shohl LLP

(57) ABSTRACT

When two abnormal cylinders are causing variation abnormality, these abnormal cylinders are identified. A parameter correlated with a degree of fluctuation of output from an air-fuel ratio sensor installed in an exhaust passage common to a plurality of cylinders is calculated. Based on the calculated parameter, inter-cylinder air-fuel ratio variation abnormality is detected. The following steps are carried out: (A) a step of forcibly changing amounts of fuel injected for two of the plurality of cylinders and calculating the parameter, (B) a step of changing the two cylinders to other two cylinders and repeating the step (A), and (C) a step of identifying two cylinders causing variation abnormality based on a plurality of the parameters calculated in the steps (A) and (B).

12 Claims, 14 Drawing Sheets

| FIG.11A |
| --- |
| FIG.11B |

| PATTERN | #1 | #2 | #3 | #4 |
|---|---|---|---|---|
| 1 | +10% | | | |
| 2 | | +10% | | |
| 3 | | | +10% | |
| 4 | | | | +10% |
| 5 | -10% | | | |
| 6 | | -10% | | |
| 7 | | | -10% | |
| 8 | | | | -10% |
| 9 | +10% | +10% | | |
| 10 | +10% | | +10% | |
| 11 | +10% | | | +10% |
| 12 | | +10% | +10% | |
| 13 | | +10% | | +10% |
| 14 | | | +10% | +10% |

FIG.12

| PATTERN | ABNORMAL CYLINDER AND ABNORMALITY TYPE |
|---|---|
| 1 | #1 LEAN |
| 2 | #2 LEAN |
| 3 | #3 LEAN |
| 4 | #4 LEAN |
| 5 | #1 RICH |
| 6 | #2 RICH |
| 7 | #3 RICH |
| 8 | #4 RICH |
| 9 | #3#4 RICH (#1#2 LEAN) |
| 10 | #2#4 RICH (#1#3 LEAN) |
| 11 | #2#3 RICH (#1#4 LEAN) |
| 12 | #1#4 RICH (#2#3 LEAN) |
| 13 | #1#3 RICH (#2#4 LEAN) |
| 14 | #1#2 RICH (#3#4 LEAN) |

FIG.13

INTER-CYLINDER AIR-FUEL RATIO VARIATION ABNORMALITY DETECTION APPARATUS

CROSS-REFERENCES TO RELATED APPLICATIONS

This application claims the benefit of Japanese Patent Application No. 2013-085953, filed Apr. 16, 2013, which is hereby incorporated by reference herein in its entirety.

BACKGROUND OF THE INVENTION

1. Field of the Invention

The present invention relates to an apparatus for detecting variation abnormality in air-fuel ratio among cylinders of a multicylinder internal combustion engine, and in particular, to an apparatus that detects abnormality (imbalance abnormality) in which abnormality in some cylinders causes the air-fuel ratio of these cylinders to deviate relatively significantly from the air-fuel ratio of the remaining cylinders.

2. Description of the Related Art

In general, an internal combustion engine with an exhaust purification system utilizing a catalyst efficiently removes harmful exhaust components using the catalyst and thus needs to control the mixing ratio between air and fuel in an air-fuel mixture combusted in the internal combustion engine, that is, the air-fuel ratio. To control the air-fuel ratio, an air-fuel ratio sensor is provided in an exhaust passage in the internal combustion engine to perform feedback control to make the detected air-fuel ratio equal to a predetermined air-fuel ratio.

On the other hand, a multicylinder internal combustion engine normally controls the air-fuel ratio using identical controlled variables for all cylinders. Thus, even when the air-fuel ratio control is performed, the actual air-fuel ratio may vary among the cylinders. In this case, if the variation is at a low level, the variation can be absorbed by the air-fuel ratio feedback control, and the catalyst also serves to remove harmful exhaust components. Consequently, such a low-level variation is prevented from affecting exhaust emissions and from posing an obvious problem.

However, if, for example, fuel injection systems for any cylinders become defective to significantly vary the air-fuel ratio among the cylinders, the exhaust emissions disadvantageously deteriorate. Such a significant variation in air-fuel ratio as deteriorates the exhaust emissions is desirably detected as abnormality. In particular, for automotive internal combustion engines, there has been a demand to detect variation abnormality in air-fuel ratio among the cylinders in a vehicle mounted state (on board) in order to prevent a vehicle with deteriorated exhaust emissions from travelling.

A possible method for detecting variation abnormality in air-fuel ratio among the cylinders involves calculating a parameter correlated with the degree of variation in output from the air-fuel ratio sensor and comparing the calculated parameter with a predetermined determination value to detect abnormality.

Furthermore, identifying an abnormal cylinder causing variation abnormality is desirable for subsequent speedy repairs or the like. In particular, the number of possible abnormal cylinders is not limited to one but may be two. Hence, if two cylinders are abnormal, the cylinders can desirably be identified.

The present invention has been made in view of the above-described circumstances. An object of the present invention is to provide an inter-cylinder air-fuel ratio variation abnormality detection apparatus which, when two abnormal cylinders are causing variation abnormality, can identity these abnormal cylinders.

SUMMARY OF THE INVENTION

An aspect of the present invention provides an inter-cylinder air-fuel ratio variation abnormality detection apparatus that calculates a parameter correlated with a degree of fluctuation of output from an air-fuel ratio sensor installed in an exhaust passage common to a plurality of cylinders to detect inter-cylinder air-fuel ratio variation abnormality based on the calculated parameter, the inter-cylinder air-fuel ratio variation abnormality detection apparatus being configured to carry out:

(A) a step of forcibly changing amounts of fuel injected for two of the plurality of cylinders and calculating the parameter;

(B) a step of changing the two cylinders to other two cylinders and repeating the step (A); and (C) a step of identifying two cylinders causing variation abnormality based on a plurality of the parameters calculated in the steps (A) and (B).

Preferably, the inter-cylinder air-fuel ratio variation abnormality detection apparatus is further configured to identify, in the step (C), two cylinders corresponding to one of the plurality of calculated parameters which minimizes a degree of a variation in air-fuel ratio as two cylinders causing the variation abnormality.

Preferably, the inter-cylinder air-fuel ratio variation abnormality detection apparatus is further configured to repeat the step (A) in the step (B) to carry out the change in the amount of injected fuel and the calculation of the parameter for all combinations of two cylinders.

Preferably, the inter-cylinder air-fuel ratio variation abnormality detection apparatus is further configured to carry out:

(D) a step of forcibly changing the amount of fuel injected for one of the plurality of cylinders and calculating the parameter; and (E) a step of changing the one cylinder to another cylinder and repeating the step (D), wherein, in step (C), one cylinder or two cylinders causing the variation abnormality are identified based on a plurality of the parameters calculated in steps (A), (B), (D), and (E).

Preferably, the inter-cylinder air-fuel ratio variation abnormality detection apparatus is further configured to also identify a type of the variation abnormality in the step (C).

Preferably, in the step (A), the change in the amount of injected fuel is an increase in the amount of injected fuel.

An excellent effect of the present invention is that, when two abnormal cylinders are causing variation abnormality, these abnormal cylinders can be identified.

Further features of the present invention will become apparent from the following description of exemplary embodiments (with reference to the attached drawings).

BRIEF DESCRIPTION OF THE DRAWINGS

FIG. 12 is a table showing an execution pattern of forced active control; and FIG. 13 is a table for identifying an abnormal cylinder and an abnormality type.

DESCRIPTION OF THE EMBODIMENTS

An embodiment of the present invention will be described below with reference to the attached drawings.

Figure 1:
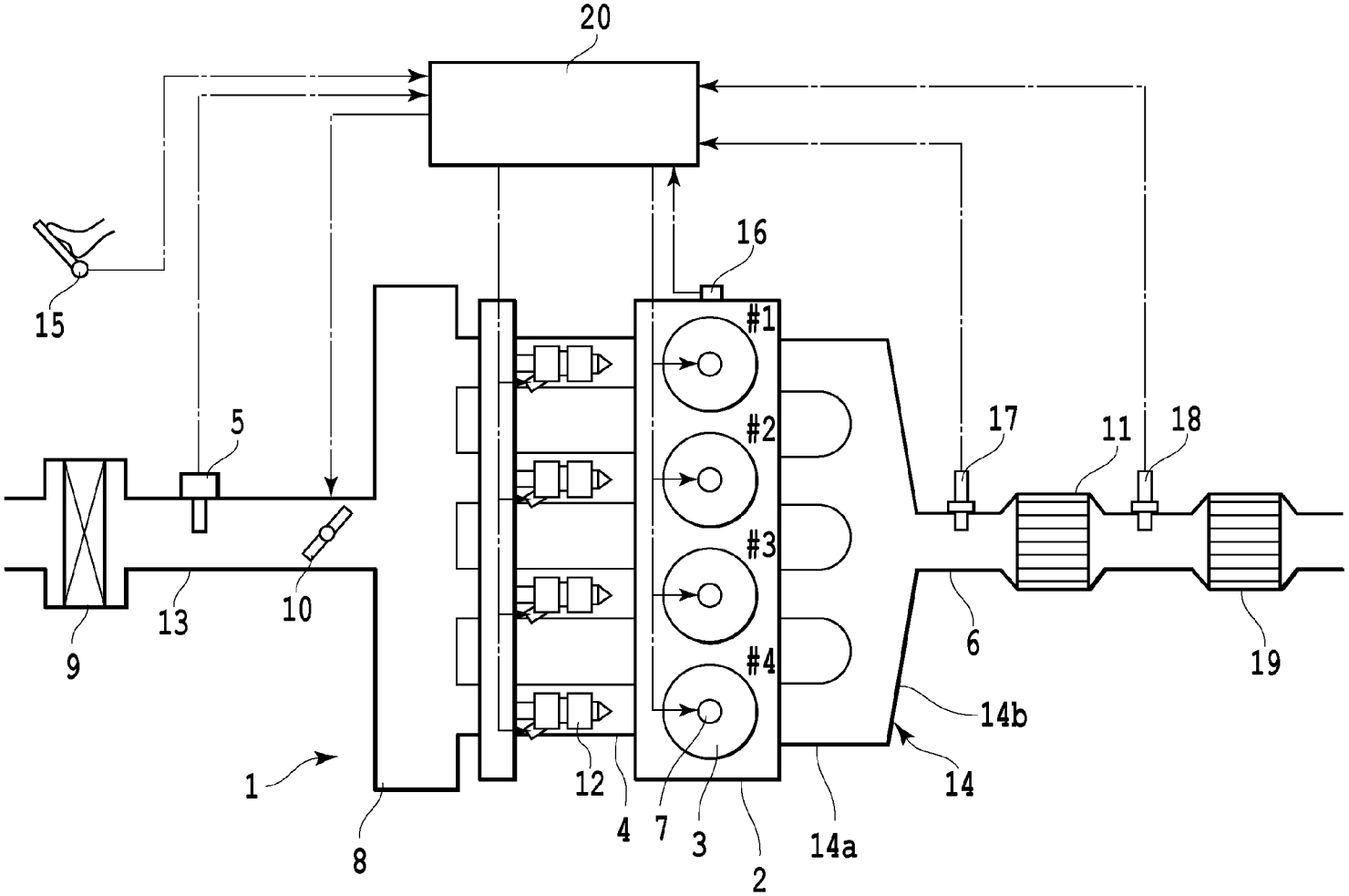
FIG. 1 is a schematic diagram of an internal combustion engine according to an embodiment of the present invention.

FIG. 1 is a schematic diagram of an internal combustion engine according to the present embodiment. An internal combustion engine (engine) 1 combusts a mixture of fuel and air inside a combustion chamber 3 formed in a cylinder block 2, and reciprocates a piston in the combustion chamber 3 to generate power. The internal combustion engine 1 includes a plurality of cylinders, and according to the present embodiment, includes four cylinders. Furthermore, the internal combustion engine 1 according to the present embodiment is a multicylinder internal combustion engine mounted in a car, more specifically, an inline-four spark ignition internal combustion engine. The number, type, and the like of the cylinders according to the present invention are not particularly limited. However, the number of cylinders is 3 or more.

Although not shown in the drawings, each cylinder includes an intake valve disposed therein to open and close an intake port and an exhaust valve disposed therein to open and close an exhaust port. Each intake valve and each exhaust valve are opened and closed by a cam shaft. Each cylinder includes an ignition plug 7 attached to a top portion of a cylinder head to ignite the air-fuel mixture in the combustion chamber 3.

The intake port of each cylinder is connected, via a branch pipe 4 for the cylinder, to a surge tank 8 that is an intake air aggregation chamber. An intake pipe 13 is connected to an upstream side of the surge tank 8, and an air cleaner 9 is provided at an upstream end of the intake pipe 13. The intake pipe 13 incorporates an air flow meter 5 (intake air amount detection device) for detecting the amount of intake air and an electronically controlled throttle valve 10, the air flow meter 5 and the throttle valve 10 being arranged in order from the upstream side. The intake port, the branch pipe 4, the surge tank 8, and the intake pipe 13 form an intake passage.

Each cylinder includes an injector (fuel injection valve) 12 disposed therein to inject fuel into the intake passage, particularly the intake port. The fuel injected by the injector 12 is mixed with intake air to form an air-fuel mixture, which is then sucked into the combustion chamber 3 when the intake valve is opened. The air-fuel mixture is compressed by the piston and then ignited and combusted by the ignition plug 7. The injector may inject fuel directly into the combustion chamber 3.

On the other hand, the exhaust port of each cylinder is connected to an exhaust manifold 14. The exhaust manifold 14 includes a branch pipe 14*a* for each cylinder which forms an upstream portion of the exhaust manifold 14 and an exhaust aggregation section 14*b* forming a downstream portion of the exhaust manifold 14. An exhaust pipe 6 is connected to the downstream side of the exhaust aggregation section 14*b*. The exhaust port, the exhaust manifold 14, and the exhaust pipe 6 form an exhaust passage.

Furthermore, the exhaust passage located downstream of the exhaust aggregation section 14*b* of the exhaust manifolds 14 forms an exhaust passage common to the #1 to #4 cylinders that are the plurality of cylinders.

Catalysts each including a three-way catalyst, that is, an upstream catalyst 11 and a downstream catalyst 19, are arranged in series and attached to an upstream side and a downstream side, respectively, of the exhaust pipe 6. The catalysts 11 and 19 have an oxygen storage capacity (O2 storage capability). That is, the catalysts 11 and 19 store excess air in exhaust gas to reduce NOx when the air-fuel ratio of exhaust gas is higher (leaner) than a stoichiometric ratio (theoretical air-fuel ratio, for example, A/F=14.6). Furthermore, the catalysts 11 and 19 emit stored oxygen to oxidize HC and CO in the exhaust gas when the air-fuel ratio of exhaust gas is lower (richer) than the stoichiometric ratio.

A first air-fuel ratio sensor and a second air-fuel ratio sensor, that is, a pre-catalyst sensor 17 and a post-catalyst sensor 18, are installed upstream and downstream, respectively, of the upstream catalyst 11 to detect the air-fuel ratio of exhaust gas. The pre-catalyst sensor 17 and the post-catalyst sensor 18 are installed immediately before and after the upstream catalyst, respectively, to detect the air-fuel ratio based on the concentration of oxygen in the exhaust. The single pre-catalyst sensor 17 is thus installed in an exhaust junction section located upstream of the upstream catalyst 11. In the present embodiment, the pre-catalyst sensor 17 corresponds to an "air-fuel ratio sensor" according to the present invention.

The ignition plug 7, the throttle valve 10, the injector 12, and the like are electrically connected to an electronic control unit (hereinafter referred to as an ECU) 20 serving as a control device or a control unit. The ECU 20 includes a CPU, a ROM, a RAM, an I/O port, and a storage device, none of which is shown in the drawings. Furthermore, the ECU connects electrically to, besides the above-described airflow meter 5, pre-catalyst sensor 17, and post-catalyst sensor 18, a crank angle sensor 16 that detects the crank angle of the internal combustion engine 1, an accelerator opening sensor 15 that detects the opening of an accelerator, and various other sensors via A/D converters or the like (not shown in the drawings). Based on detection values from the various sensors, the ECU 20 controls the ignition plug 7, the throttle valve 10, the injector 12, and the like to control an ignition period, the amount of injected fuel, a fuel injection period, a throttle opening, and the like in accordance with various program stored in the ROM so as to obtain desired outputs.

The throttle valve 10 includes a throttle opening sensor (not shown in the drawings), which transmits a signal to the ECU 20. The ECU 20 feedback-controls the opening of the throttle valve 10 (throttle opening) to a target throttle opening dictated according to the accelerator opening.

Based on a signal from the air flow meter 5, the ECU 20 detects the amount of intake air, that is, an intake flow rate, which is the amount of air sucked per unit time. The ECU 20 detects a load on the engine 1 based on one of the detected throttle opening and amount of intake air.

Based on a crank pulse signal from the crank angle sensor 16, the ECU 20 detects the crank angle itself and the number of rotations of the engine 1. Here, the "number of rotations" refers to the number of rotations per unit time and is used synonymously with rotation speed. According to the present embodiment, the number of rotations refers to the number of rotations per minute rpm.

Figure 2:
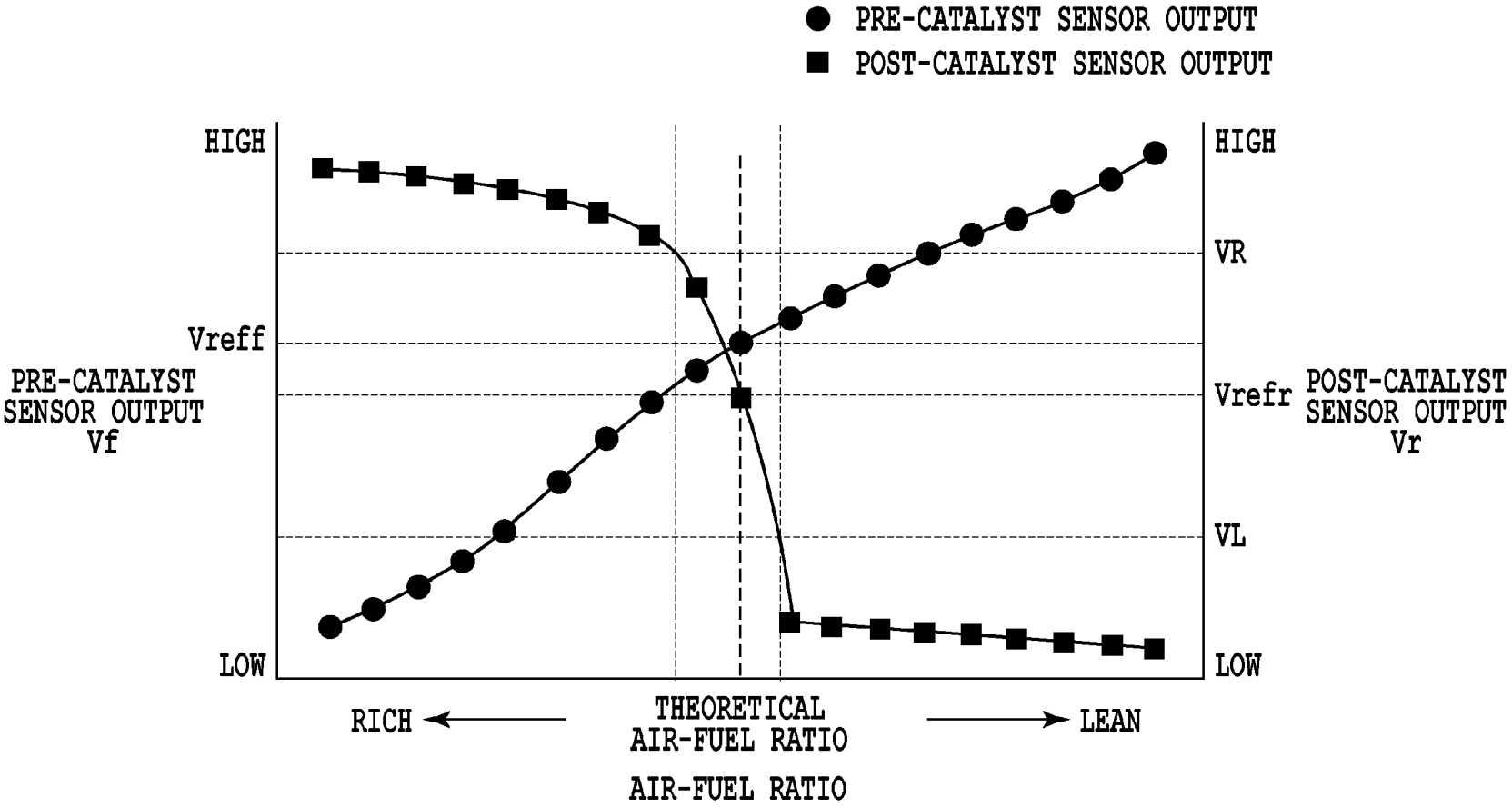
FIG. 2 is a graph showing the output characteristics of a pre-catalyst sensor and a post-catalyst sensor.

The pre-catalyst sensor 17 includes what is called a wide-range air-fuel ratio sensor and can consecutively detect a relatively wide range of air-fuel ratios. FIG. 2 shows output characteristic of the pre-catalyst sensor 17. As shown in FIG. 2, the pre-catalyst sensor 17 outputs a voltage signal Vf of a magnitude proportional to an exhaust air-fuel ratio. An output voltage obtained when the exhaust air-fuel ratio is stoichiometric is Vreff (for example, 3.3 V).

On the other hand, the post-catalyst sensor 18 includes what is called an O2 sensor and is characterized by an output value changing rapidly beyond the stoichiometric ratio. FIG. 2 shows the output characteristic of the post-catalyst sensor. As shown in FIG. 2, an output voltage obtained when the exhaust air-fuel ratio is stoichiometric, that is, a stoichiometrically equivalent value is Vrefr (for example, 0.45 V). The output voltage of the post-catalyst sensor 21 varies within a predetermined range (for example, from 0 V to 1 V). When the exhaust air-fuel ratio is leaner than the stoichiometric ratio, the output voltage of the post-catalyst sensor is lower than the stoichiometrically equivalent value Vrefr. When the exhaust air-fuel ratio is richer than the stoichiometric ratio, the output voltage of the post-catalyst sensor is higher than the stoichiometrically equivalent value Vrefr.

The upstream catalyst 11 and the downstream catalyst 19 simultaneously remove NOx, HC, and CO, which are harmful components in the exhaust, when the air-fuel ratio of exhaust gas flowing into each of the catalysts is close to the stoichiometric ratio. The range (window) of the air-fuel ratio within which the three components can be efficiently removed at the same time is relatively narrow.

Thus, during normal operation, the ECU 20 performs air-fuel ratio feedback control so as to control the air-fuel ratio of exhaust gas flowing into the upstream catalyst 11 to the neighborhood of the stoichiometric ratio. The air-fuel ratio feedback control includes main air-fuel ratio control that controls the amount of injected fuel to make the exhaust air-fuel ratio detected by the pre-catalyst sensor 17 equal to the stoichiometric ratio, a predetermined target air-fuel ratio (main air-fuel ratio feedback control) and sub air-fuel ratio control that controls the amount of injected fuel to make the exhaust air-fuel ratio detected by the post-catalyst sensor 18 equal to the stoichiometric ratio (sub air-fuel ratio feedback control).

The air-fuel ratio feedback control using the stoichiometric ratio as the target air-fuel ratio is referred to as stoichiometric control. The stoichiometric ratio corresponds to a reference air-fuel ratio. The stoichiometric control uniformly corrects the amount of injected fuel for all the cylinders by the same value.

For example, abnormality in a fuel system or an air system may occur in some of all the cylinders to cause a variation (imbalance) in the air-fuel ratio among the cylinders. For example, the injector 12 for the #1 cylinder may fail, and a larger amount of fuel may be injected for the #1 cylinder than for the other cylinders, the #2, #3, and #4 cylinders. Thus, the air-fuel ratio in the #1 cylinder may be shifted significantly toward a rich side. Even in this case, the air-fuel ratio of total gas supplied to the pre-catalyst sensor 17 may be controlled to the stoichiometric ratio by performing the above-described stoichiometric control to apply a relatively large amount of correction. However, the air-fuel ratios of the individual cylinders are such that the air-fuel ratio of the #1 cylinder is much richer than the stoichiometric ratio, whereas and the air-fuel ratio of the #2, #3, and #4 cylinders is slightly leaner than the stoichiometric ratio. Thus, the air-fuel ratios are only totally in balance; only the total air-fuel ratio is stoichiometric. This is not preferable for emission control. Thus, the present embodiment includes an apparatus that detects such variation abnormality in air-fuel ratio among the cylinders.

An aspect of variation abnormality detection according to the present embodiment will be described below.

Figure 3:
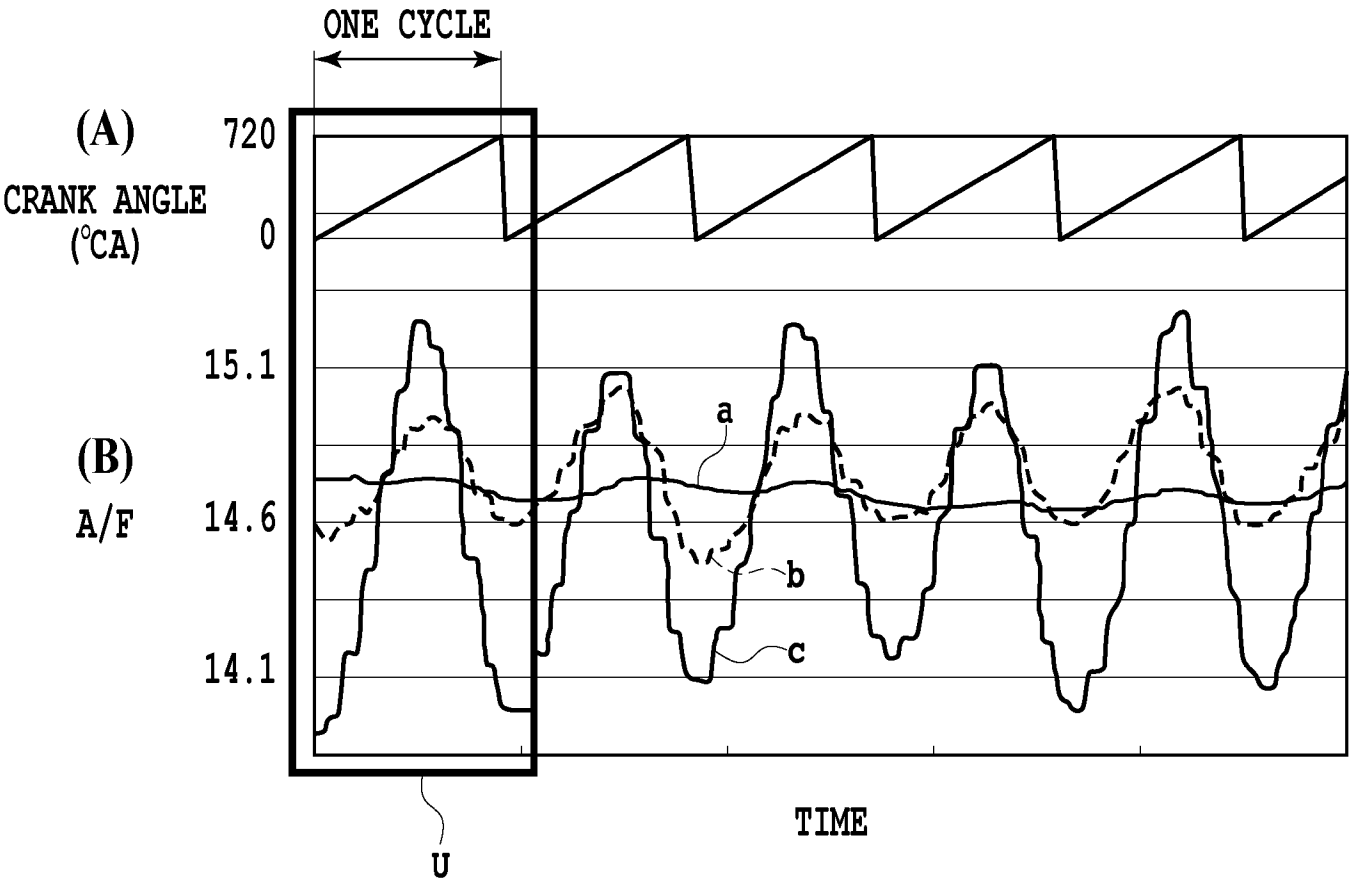
FIG. 3 is a graph showing a variation in exhaust air-fuel ratio according to the degree of a variation in air-fuel ratio among cylinders.

As schematically shown in FIG. 3, when an inter-cylinder air-fuel variation occurs, the exhaust air-fuel ratio varies significantly during one engine cycle (=720° CA). Air-fuel ratio lines a, b, c in (B) show air-fuel ratios detected by the pre-catalyst sensor 17 when no variation occurs in air-fuel ratio, when the air-fuel ratio shifts toward the rich side in only one cylinder at an imbalance rate of +20%, and when the air-fuel ratio shifts toward the rich side in only one cylinder at an imbalance rate of +50%, respectively. As seen in the air-fuel ratio lines, the amplitude of the variation in air-fuel ratio increases consistently with the degree of the variation among the cylinders.

In this case, the imbalance rate is a parameter representing the degree of the variation in air-fuel ratio among the cylinders. That is, the imbalance rate is a value representing the rate at which, if only one of all the cylinders is subjected to a deviation of the amount of injected fuel, the amount of fuel injected for the cylinder subjected to the deviation of the amount of injected fuel (imbalanced cylinder) deviates from the amount of fuel injected for the cylinders free from the deviation of the amount of injected fuel (balanced cylinders), that is, a reference injection amount. When the imbalance rate is denoted by IB, the amount of fuel injected for the imbalanced cylinder is denoted by Qib, and the amount of fuel injected for the balanced cylinders, that is, the reference injection amount, is denoted by Qs, IB=(Qib−Qs).

An increase in imbalance rate IB increases the deviation of the amount of injected fuel between the imbalanced cylinder and the balanced cylinders and also increases the degree of a variation in air-fuel ratio. According to the present embodiment, the reference injection amount Qs is equal to a stoichiometrically equivalent amount of injected fuel.

As seen in FIG. 3, fluctuation of output from the pre-catalyst sensor 17 increases consistently with the imbalance rate, that is, with the degree of a variation in air-fuel ratio among the cylinders.

Hence, utilizing this property, the present embodiment uses an output fluctuation parameter X correlated with the degree of fluctuation of output from the pre-catalyst sensor 17 as a parameter correlated with the degree of a variation in air-fuel ratio among the cylinders and calculates (or detects) the output fluctuation parameter X. Then, based on the calculated output fluctuation parameter X, variation abnormality is detected. Then imbalance rate is used only for the purpose of description.

Figure 4:
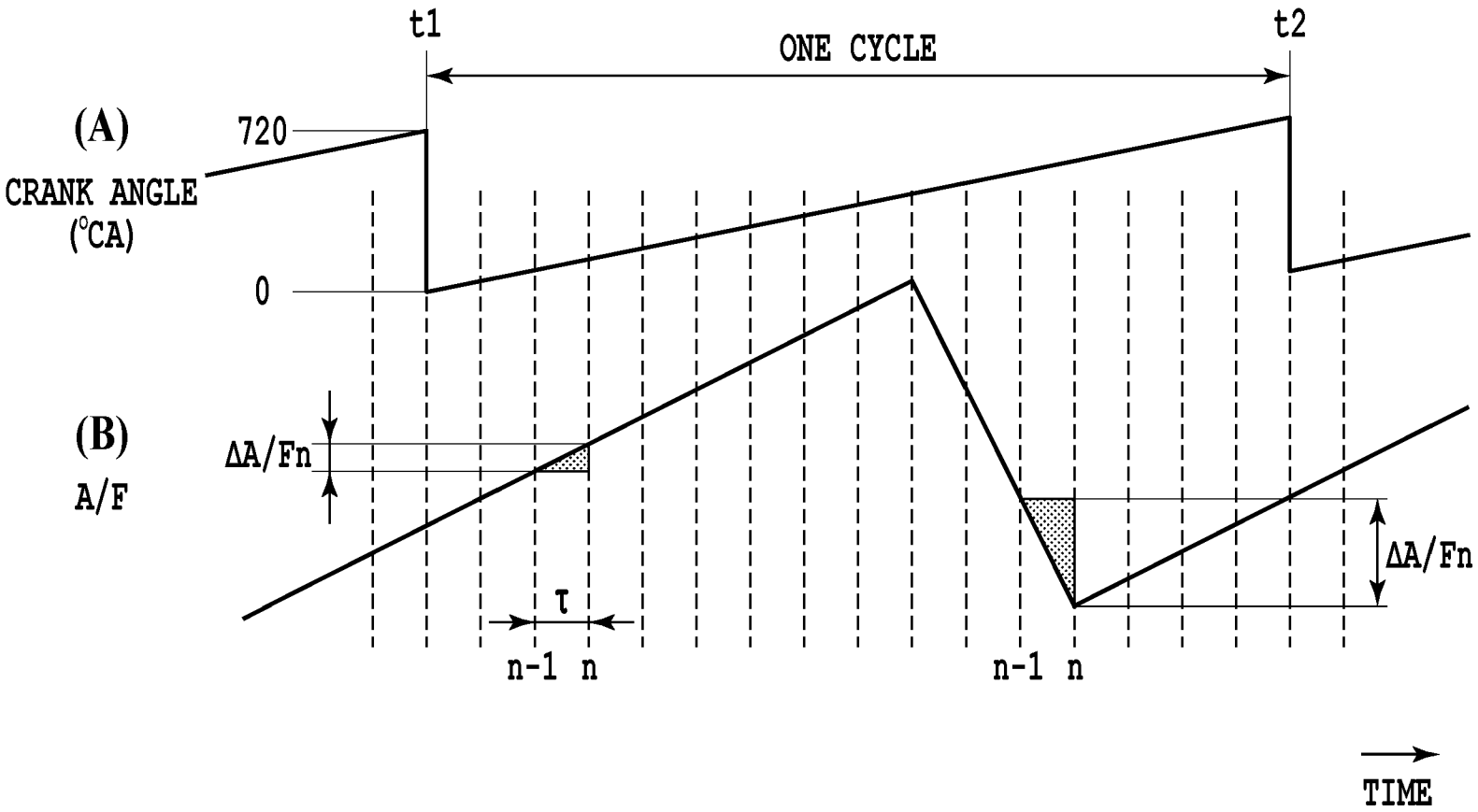
FIG. 4 is an enlarged view corresponding to a U portion of FIG. 3.

A method for calculating the output fluctuation parameter X will be described below. FIG. 4 is an enlarged view corresponding to a U portion of FIG. 3. In particular, FIG. 4 simply shows a variation in output from the pre-catalyst sensor during one engine cycle. As the output from the pre-catalyst sensor, a value is used which results from conversion of an output voltage Vf from the pre-catalyst sensor 17 into an air-fuel ratio A/F. However, the output voltage Vf from the pre-catalyst sensor 17 can also be directly used.

As shown in FIG. 4(B), the ECU 20 acquires the pre-catalyst sensor output A/F at each predetermined sample period τ during one engine cycle. The ECU 20 then determines the absolute value of the difference between a value A/Fn acquired at the current (n) timing and a value A/Fn−1 acquired at the preceding (n−1) timing using Formula (1) shown below (the absolute value is hereinafter referred to as an output difference). The output difference ΔA/Fn can be replaced with an absolute value of a differential value or an inclination obtained at the current timing.

$$\Delta A/F_n = |A/F_n - A/F_{n-1}| \quad (1)$$

Simply stated, the output difference ΔA/Fn represents fluctuation of the pre-catalyst sensor output. This is because the inclination of an air-fuel ratio diagram and thus the output difference ΔA/Fn increase consistently with the degree of fluctuation. Consequently, the value of the output difference ΔA/Fn at a predetermined timing can be used as the output fluctuation parameter.

However, for improved accuracy, the present embodiment uses the average value of a plurality of output differences ΔA/Fn as the output fluctuation parameter. The present embodiment determines the output fluctuation parameter X by integrating the output difference ΔA/Fn at every sample period τ during M engine cycles (M denotes an integer of 2 or more, for example, M=100) and dividing the final integrated value by the number of samples. The output fluctuation parameter X increases consistently with the degree of fluctuation of the pre-catalyst sensor output.

The pre-catalyst sensor output A/F may increase or decrease, and thus, the output difference ΔA/Fn or the average value thereof may be determined exclusively for one of the case of increase and the case of decrease and used as the output fluctuation parameter. In particular, if a rich shift occurs only in one cylinder, the output from the pre-catalyst sensor tends to decrease rapidly (changes to a rich side) when the pre-catalyst sensor receives exhaust gas corresponding to this cylinder. Hence, using only the decrease-side values to detect rich shift abnormality is possible. Of course, the present invention is not limited to this, but using only the increase-side values is also possible.

Furthermore, any value correlated with the degree of a variation in pre-catalyst sensor output can be used as the output fluctuation parameter. For example, the output fluctuation parameter may be calculated based on the difference between the maximum peak and minimum peak (what is called, a peak-to-peak value) of the pre-catalyst sensor output during one engine cycle or the absolute value of the maximum peak or minimum peak of a second-order differential value. This is because an increase in the degree of fluctuation of the pre-catalyst sensor output increases the difference between the maximum peak and minimum peak of the pre-catalyst sensor output and the absolute value of the maximum peak or minimum peak of a second-order differential value.

Figure 5:
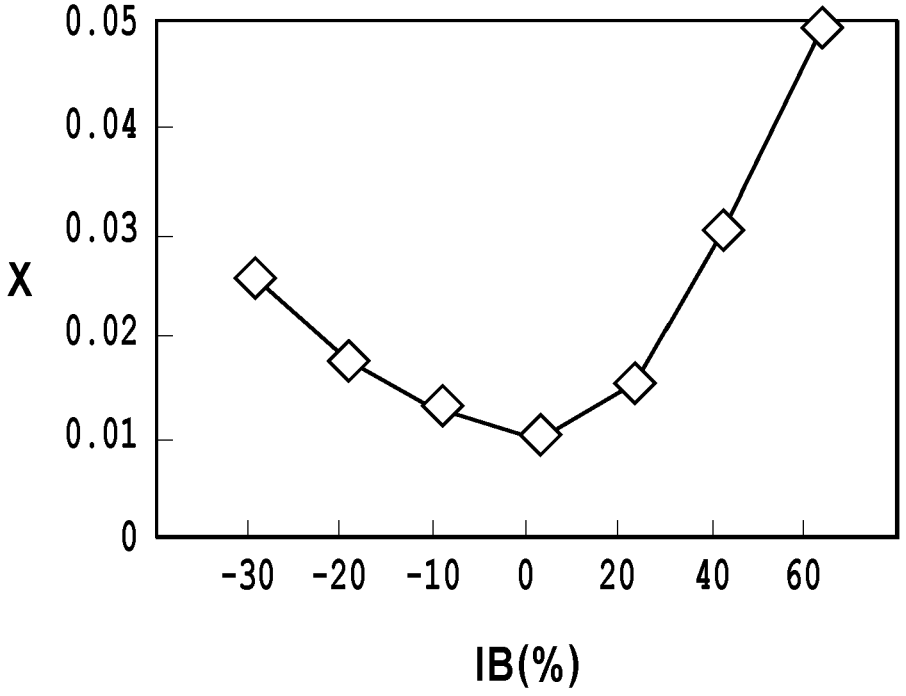
FIG. 5 is a graph showing a relation between an imbalance ratio and an output fluctuation parameter.

FIG. 5 shows a relation between the imbalance rate IB (%) and the output fluctuation parameter X. As shown in FIG. 5, the imbalance rate IB (%) and the output fluctuation parameter X have a strong correlation, and the output fluctuation parameter X tends to increase consistently with the absolute value of the imbalance rate IB.

Whether or not variation abnormality is present can be determined by comparing the calculated output fluctuation parameter X with a predetermined determination value. For example, variation abnormality is determined to be present (abnormal) if the calculated output fluctuation parameter X is equal to or larger than the determination value. Variation abnormality is determined to be absent (normal) if the calculated output fluctuation parameter X is smaller than the determination value.

When variation abnormality is detected, an abnormal cylinder causing the variation abnormality, that is, a cylinder causing an air-fuel ratio shift, can desirably also be identified for subsequent speedy repairs. On the other hand, the number of possible abnormal cylinders is not limited to one but may be two. Hence, if two cylinders are abnormal, the two cylinders can desirably be identified.

Thus, according to the present embodiment, variation abnormality is detected by a method described below, and when two cylinders are abnormal, the two cylinders can be identified.

Now, the method for identifying an abnormal cylinder and the principle of the method according to the present embodiment will be described with reference to FIGS. 6A-6F.

Figure 6A:
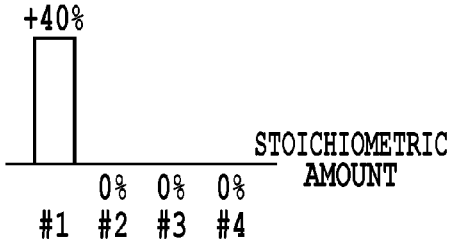
FIGS. 6A-6F are diagrams illustrating a method for identifying an abnormal cylinder and the principle of the method.

As shown in FIG. 6A, it is assumed that, for example, only the #1 cylinder is abnormal and the amount of fuel injected for the #1 cylinder has increased by 40% compared to the stoichiometrically equivalent amount (that is, the imbalance rate is +40(%)), and in the other, #2, #3, and #4 cylinders, the amount of injected fuel is equal to the stoichiometrically equivalent amount (that is, the imbalance rate is 0%). At this time, when stoichiometric control is performed for a certain time, the imbalance rate of the #1 cylinder changes to +30% and the imbalance rate of the #2, #3, and #4 cylinders changes to −10% so that the total amount of injected fuel is equal to the stoichiometrically equivalent amount. At this time, a positive or negative deviation of the amount of injected fuel also occurs in each of the cylinders.

Figure 6B:
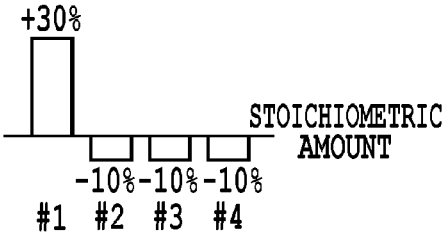
Figure 6C:
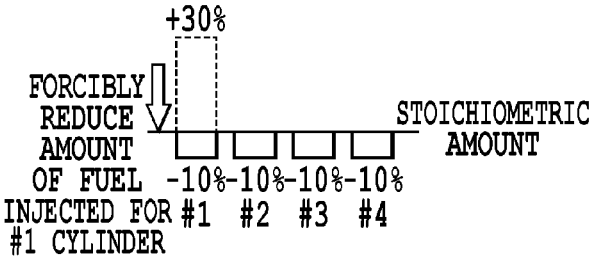

It is assumed that, in the state in FIG. 6B, the amount of fuel injected for the #1 cylinder is forcibly or actively reduced by 40% of the stoichiometrically equivalent amount, for example, as shown in FIG. 6C. Then, the imbalance rate of the #1 cylinder is −10%, which is equal to the imbalance rate of the other, #2, #3, and #4 cylinders.

In this state, with the forced reduction state maintained in the #1 cylinder, stoichiometric control is performed for a certain time. Then, as shown in FIG. 6D, the amount of fuel injected for each cylinder is corrected by +10% to be equal to the stoichiometrically equivalent amount (that is, the imbalance rate of each cylinder is 0%).

Figure 6D:
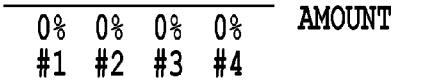

Although not shown in the drawings, the output fluctuation parameter X has a large value in the state shown in FIG. 6A but has a small value in the state shown in FIG. 6D. This enables the identification, as an abnormal cylinder (particularly a rich shift abnormal cylinder), of a cylinder that decreases by a predetermined value or larger, or to a predetermined value or smaller, in the output fluctuation parameter X when the amount of injected fuel is forcibly reduced.

Figure 6E:
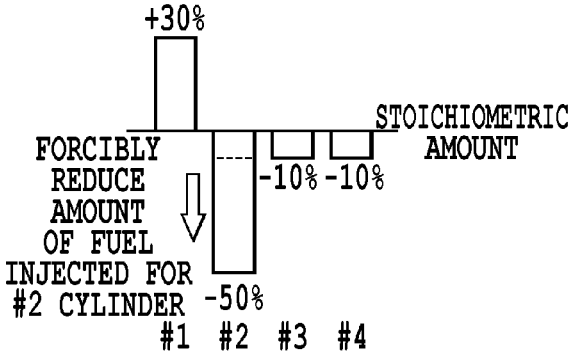

On the other hand, it is assumed that, in the state in FIG. 6B, the amount of injected fuel is forcibly reduced in the normal, #2 cylinder by 40% of the stoichiometrically equivalent amount, for example, as shown in FIG. 6E. Then, the imbalance rate of each cylinder is as follows. The imbalance rate of the #1 cylinder is unchanged and is thus +30%. The imbalance rate of the #2 cylinder changes to −50%. The imbalance rate of the #3 and #4 cylinders is unchanged and is thus −10%.

In this state, with the forced reduction state maintained in the #2 cylinder, stoichiometric control is performed for a certain time. Then, as shown in FIG. 6F, the imbalance rate is set to +40% in the #1 cylinder, to −40% in the #2 cylinder, and to 0% in the #3 and #4 cylinders so that the total amount of injected fuel is equal to the stoichiometrically equivalent amount.

Figure 6F:
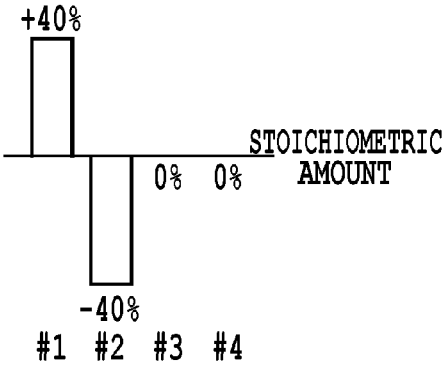

In this case, although not shown in the drawings, the value of the output fluctuation parameter X does not decrease significantly from the state shown in FIG. 6A to the state shown in FIG. 6F. This enables the identification, as a normal cylinder and not as an abnormal cylinder, of a cylinder that does not decrease by the predetermined value or larger, or to the predetermined value or smaller, in the output fluctuation parameter X when the amount of injected fuel is forcibly reduced.

Although not shown in the drawings, it is assumed that, for example, in the example in FIG. 6A, only the #1 cylinder is abnormal and has decreased by 40% in the amount of injected fuel (that is, the imbalance rate is −40%). This enables the identification, as an abnormal cylinder (particularly a lean shift abnormal cylinder), of a cylinder that decreases by a predetermined value or larger, or to a predetermined value or smaller, in the output fluctuation parameter X when the amount of injected fuel is forcibly increased for each cylinder. The other cylinders can be identified as normal cylinders.

An increase in the amount of injected fuel and a decrease in the amount of injected fuel are hereinafter collectively referred to as a change in the amount of injected fuel. Furthermore, control that forcibly changes the amount of injected fuel as described above is hereinafter referred to as forcible active control.

In the above-described method, one cylinder is abnormal. However, if two cylinders are abnormal, identifying the abnormal cylinders by exactly the same method is difficult.

Figure 7:
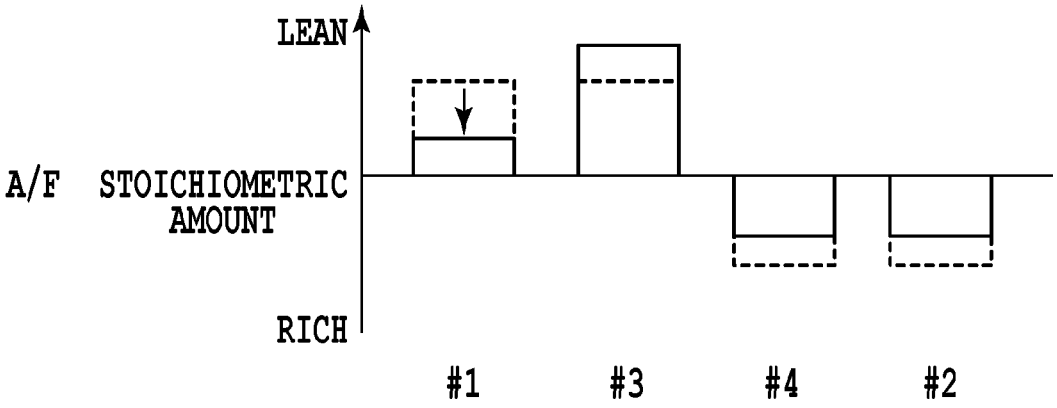
FIG. 7 is a diagram showing how the air-fuel ratio varies among the cylinders and showing an example in which a lean shift is occurring in a #1 cylinder and a #3 cylinder.

FIG. 7 shows how the air-fuel ratio varies among the cylinders. The axis of ordinate represents the air-fuel ratio A/F, and the cylinders on the axis of abscissas are shown in the order that ignition occurs in the cylinder, that is, #1, #3, #4, and #2. Dashed lines show a state before the forced active control. Solid lines show a state after the forced active control.

In the example in FIG. 7, a lean shift is occurring in two cylinders that are consecutive in the order of ignition, specifically, the #1 and #3 cylinders. As a result of the stoichiometric control, the air-fuel ratio of the #4 and #2 cylinders is shifted toward the rich side so as to make the total air-fuel ratio stoichiometric.

In this state, it is assumed that the amount of injected fuel is forcibly increased only for the #1 cylinder in order to reduce the lean shift as is the case with the above-described method. In this case, the air-fuel ratio of each cylinder is as shown by solid lines in FIG. 7. The lean shift in the #3 cylinder has not been eliminated but has rather increased. The degree of a variation in air-fuel ratio among the cylinders is still high, and thus, only a slight decrease occurs in the output fluctuation parameter X between the state before the forced active control and the state after the forced active control. The #1 and #3 cylinders are difficult to be identified as abnormal cylinders. This also applies even when the amount of injected fuel is forcibly increased for the #3 cylinder instead of the #1 cylinder.

Figure 8:
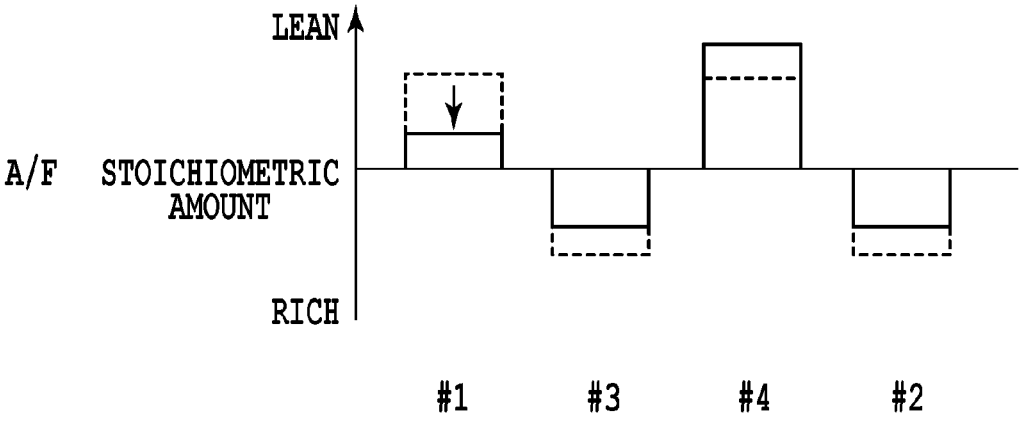
FIG. 8 is a diagram showing how the air-fuel ratio varies among the cylinders and showing an example in which a lean shift is occurring in the #1 cylinder and a #4 cylinder.

In an example in FIG. 8, a lean shift is occurring in two cylinders that are separate from each other by 180° CA in the order of ignition, specifically, in the #1 and #4 cylinders, as shown by dashed lines. As a result of the stoichiometric control, the air-fuel ratio of the #3 and #2 cylinders is shifted toward the rich side so as to make the total air-fuel ratio stoichiometric.

In this state, it is assumed that the amount of injected fuel is forcibly increased only for the #1 cylinder in order to reduce the lean shift. In this case, the air-fuel ratio of each cylinder is as shown by solid lines in FIG. 8. The lean shift in the #4 cylinder has not been eliminated but has rather increased. The degree of a variation in air-fuel ratio among the cylinders is still high, and thus, only a slight decrease occurs in the output fluctuation parameter X between the state before the forced active control and the state after the forced active control. The #1 and #4 cylinders are difficult to be identified as abnormal cylinders. This also applies even when the amount of injected fuel is forcibly increased for the #4 cylinder instead of the #1 cylinder.

As described above, when one cylinder is abnormal, the abnormal cylinder can be identified by forcibly changing the amount of fuel injected for this cylinder so as to reduce the air-fuel ratio shift in the cylinder, thus decreasing the output fluctuation parameter X. However, if two cylinders are abnormal, even when the amount of injected fuel is forcibly changed so as to reduce the air-fuel ratio shift in one of the two cylinders, the value of the output fluctuation parameter X fails to be decreased. This precludes the two abnormal cylinders from being identified.

Thus, the present embodiment not only forcibly changes the amount of fuel injected for one cylinder but also forcibly changes the amounts of fuel injected for two cylinders. Thus, when two cylinders are abnormal, the two cylinders can be reliably identified as described below in detail.

Figure 9:
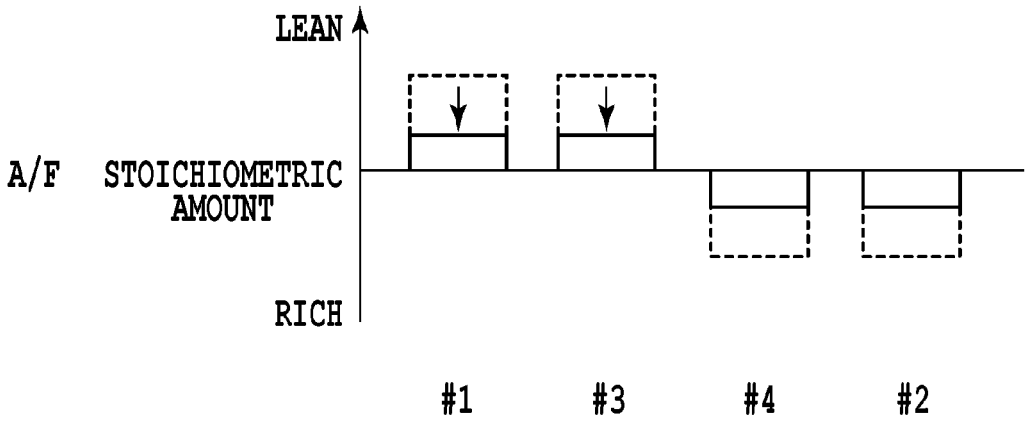
FIG. 9 is a diagram showing how the air-fuel ratio varies among the cylinders and showing an example in which a lean shift is occurring in the #1 cylinder and the #3 cylinder.

Like FIG. 7, FIG. 9 shows an example in which a lean shift is occurring in the #1 and #3 cylinders. In this case, the amount of injected fuel is forcibly increased for the two cylinders, the #1 and #3 cylinders, so as to reduce the lean shifts in these cylinders. The air-fuel ratio of each cylinder resulting from the increase in the amount of injected fuel is as shown by solid lines in FIG. 9. The lean shifts in the #1 and #3 cylinders have been eliminated, and the degree of a variation in air-fuel ratio among the cylinders has been reduced. This increases the amount of decrease in the output fluctuation parameter X between the state before the forced active control and the state after the forces active control, enabling the #1 and #3 cylinders to be identified as lean shift abnormal cylinders.

Figure 10:
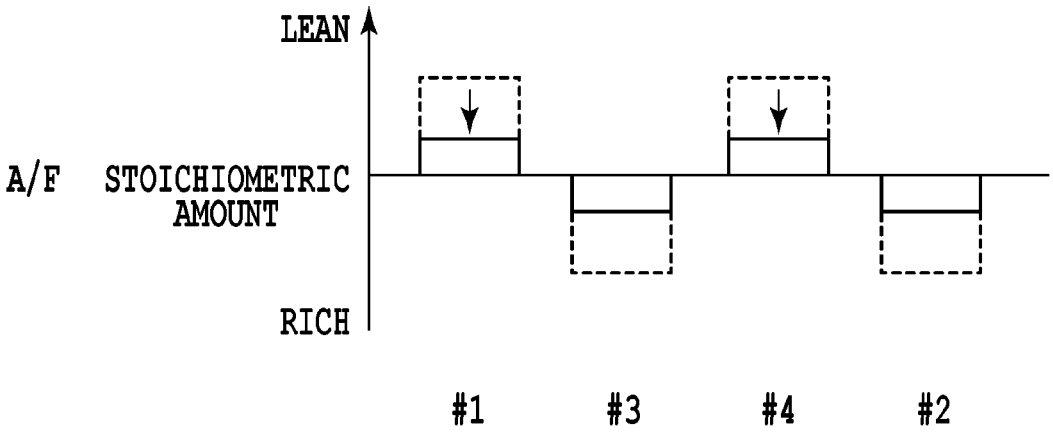
FIG. 10 is a diagram showing how the air-fuel ratio varies among the cylinders and showing an example in which a lean shift is occurring in the #1 cylinder and the #4 cylinder.

Like FIG. 8, FIG. 10 shows an example in which a lean shift is occurring in the #1 and #4 cylinders. Also in this case, the amount of injected fuel is forcibly increased for the two cylinders, the #1 and #4 cylinders, so as to reduce the lean shifts in these cylinders. The air-fuel ratio of each cylinder resulting from the increase in the amount of injected fuel is as shown by solid lines in FIG. 10. The lean shifts in the #1 and #4 cylinders have been eliminated, and the degree of a variation in air-fuel ratio among the cylinders has been reduced. This increases the amount of decrease in the output fluctuation parameter X between the state before the forced active control and the state after the forces active control, enabling the #1 and #4 cylinders to be identified as lean shift abnormal cylinders.

Two cylinders with rich shift abnormality occurring therein can be similarly identified by forcibly reducing the amounts of fuel injected for these cylinders.

For the four-cylinder engine according to the present embodiment, 14 patterns of control are performed including 4 patterns in which the amount of injected fuel is forcibly increased for every cylinder in sequence, 4 patterns in which the amount of injected fuel is forcibly reduced for every cylinder in sequence, and 6 patterns in which the amount of injected fuel is forcibly increased for every two cylinders in sequence. For each pattern, the output fluctuation parameter X is calculated. Then, the cylinders corresponding to one of the patterns resulting in the minimum calculated value of the output fluctuation parameter X are identified as abnormal cylinders.

Figures 11, 11A:
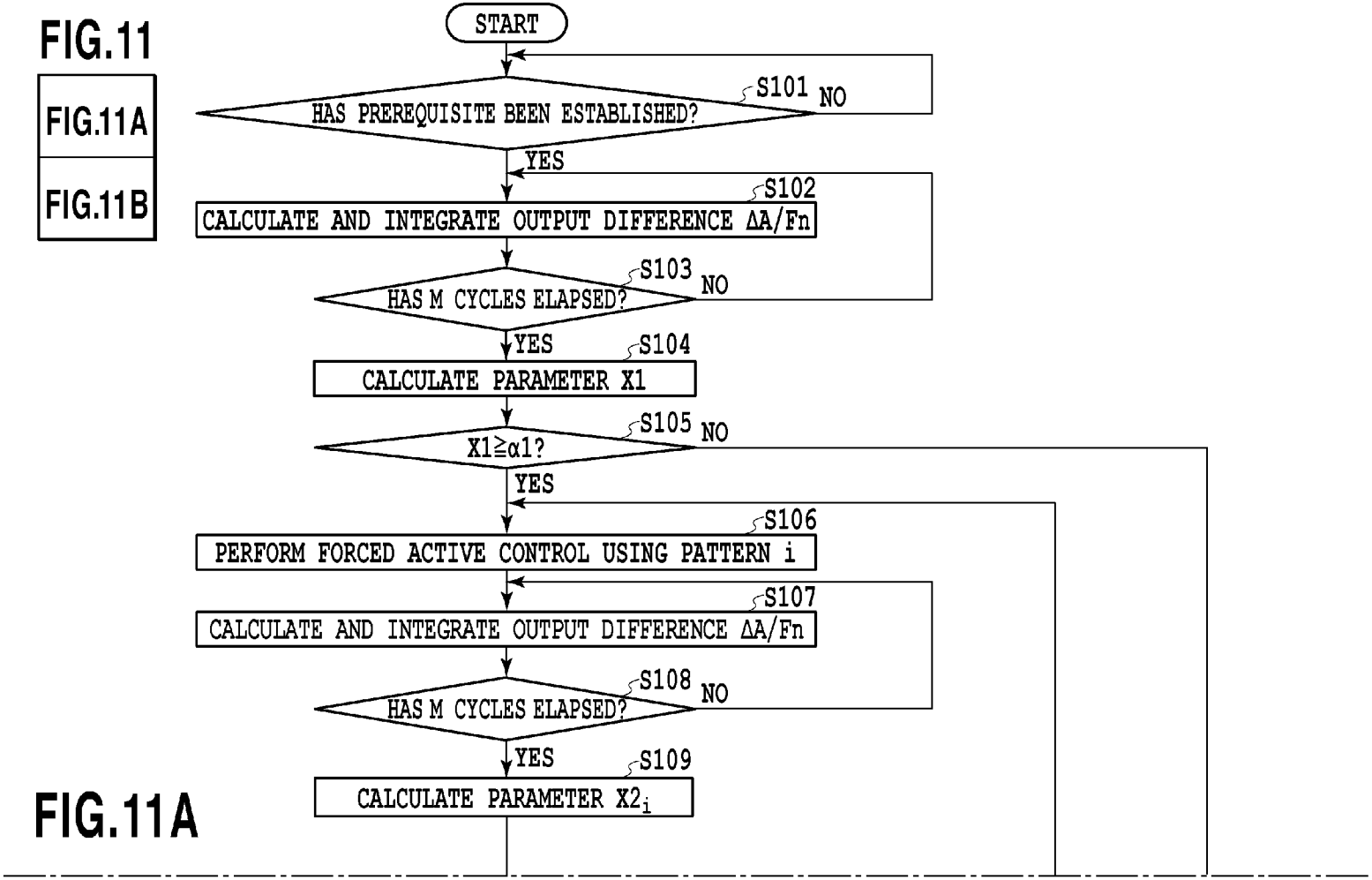
FIG. 11 is a diagram showing a relation between FIGS. 11A and 11B.
FIGS. 11A and 11B illustrate a flowchart of a process of detecting variation abnormality.
Figure 11B:
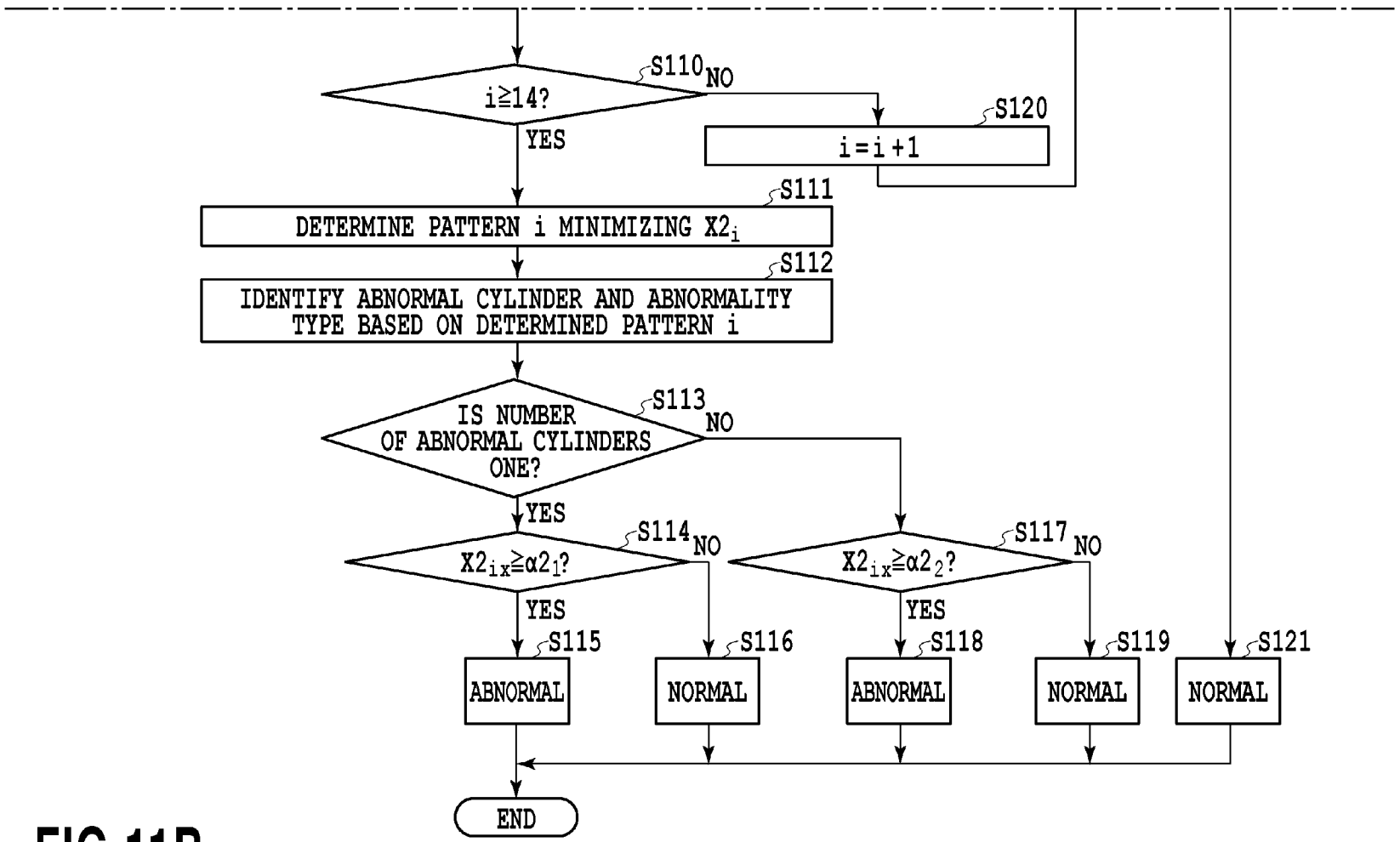

Now, a specific process of detecting variation abnormality according to the present embodiment will be described. This detection process is carried out by the ECU 20 in accordance with such an algorithm as shown in FIGS. 11A and 11B.

First, in step S101, the ECU 20 determines whether or not a predetermined prerequisite suitable for performing variation abnormality detection has been established. For example, the prerequisite is established when the following conditions are met.

(1) Warm-up of the engine is completed.

(2) The pre-catalyst sensor 17 and the post-catalyst sensor 18 have been activated.

(3) The upstream catalyst 11 and the downstream catalyst 19 have been activated.

(4) The number of rotations Ne of the engine and a load KL on the engine fall within respective predetermined ranges. For example, the number of rotations Ne falls within the range from 1,200 rpm to 2,000 rpm, and the load KL falls within the range from 40% to 60%.

(5) Stoichiometric control is in operation.

Another example of the prerequisite is possible. For example, the following condition may be added: (6) the engine is in steady operation.

If the prerequisite has not been established, the ECU 20 waits for establishment. If the prerequisite has been established, the ECU 20 proceeds to step S102. Steps subsequent to step S102 are carried out only when the prerequisite has been established.

In steps S102 to S104, the ECU 20 calculates the value of an output fluctuation parameter X1 in a state where the forced active control is deactivated (or before the forced active control is activated), that is, in an normal state.

First, in step S102, the ECU 20 sequentially calculates and integrates the output difference ΔA/Fn. Then, in step S103, the ECU 20 determines whether or not M engine cycles have elapsed. If M engine cycles have not elapsed, the ECU 20 returns to step S102. If M engine cycles have elapsed, the ECU 20 calculates the value of the output fluctuation parameter X1 in step S104. At this time, the ECU 20 divides the integral value of the output difference ΔA/Fn integrated during the M engine cycles, by the number of samples to determine the value of the output fluctuation parameter X1.

Then, in step S105, the ECU 20 compares the value of the output fluctuation parameter X1 with a predetermined determination value al. When $X1<\alpha1$, the ECU 20 proceeds to step S121 to determine normality, that variation abnormality is not occurring. The ECU 20 thus ends the detection process. Other hand, when $X1\geq\alpha1$, the ECU 20 fails to determine that the cylinder is normal, and abnormality is likely to be occurring. The ECU 20 thus proceeds to steps subsequent to step S106 in order to finally determine whether the engine is normal or abnormal.

Step S105 substantially makes a primary determination of whether or not the engine is normal. When the engine is determined not to be normal, the subsequent step S114 or S117 makes a secondary determination of whether the engine is normal or abnormal.

Step S106 performs the forced active control in accordance with a predetermined pattern i. The reference character i denotes an integer of 1 to 14. Each pattern is as shown in FIG. 12.

As shown in FIG. 12, for example, pattern 1 is a pattern in which the amount of fuel injected for the #1 cylinder is increased by 10% (represented as +10%) with respect to the stoichiometrically equivalent amount. Similarly, patterns 2, 3, and 4 are patterns in which the amounts of fuel injected for the #2, #3, and #4 cylinders, respectively, are increased by 10% with respect to the stoichiometrically equivalent amount.

Pattern 5 is a pattern in which the amount of fuel injected for the #1 cylinder is reduced by 10% (represented as −10%) with respect to the stoichiometrically equivalent amount. Similarly, patterns 6, 7, and 8 are patterns in which the amounts of fuel injected for the #2, #3, and #4 cylinders, respectively, are reduced by 10% with respect to the stoichiometrically equivalent amount.

Pattern 9 is a pattern in which the amounts of fuel injected for the #1 and #2 cylinders are increased by 10% with respect to the stoichiometrically equivalent amount. Similarly, pattern 10 is a pattern in which the amounts of fuel injected for the #1 and #3 cylinders are increased by 10% with respect to the stoichiometrically equivalent amount. Pattern 11 is a pattern in which the amounts of fuel injected for the #1 and #4 cylinders are increased by 10%. Pattern 12 is a pattern in which the amounts of fuel injected for the #2 and #3 cylinders are increased by 10%. Pattern 13 is a pattern in which the amounts of fuel injected for the #2 and #4 cylinders are increased by 10%. Pattern 14 is a pattern in which the amounts of fuel injected for the #3 and #4 cylinders are increased by 10%. Patterns 9 to 14 cover all combinations of two cylinders. In this case, no pattern involving a reduction in the amount of injected fuel is provided because a pattern involving an increase in the amounts of fuel injected for two cylinders produces the same result as that of a pattern involving a reduction in the amounts of fuel injected for two cylinders.

This allows the covering of an increase and a decrease in the amount of injected fuel in each cylinder and an increase in the amount of injected fuel in all the combinations of two cylinders. Thus, an abnormal cylinder can be accurately identified. Any other method can be used to increase or reduce the amount of injected fuel.

With reference back to FIGS. 11A and 11B, when step S106 is carried out for the first time, i=1 (that is, the initial value of i is 1) and the forced active control is performed using pattern 1.

Then, in step S107, the ECU 20 calculates and integrates the output difference ΔA/Fn, as is the case with step S102. Then, in step S108, the ECU 20 determines whether or not M engine cycles have elapsed, as is the case with step S103. If M engine cycles have not elapsed, the ECU 20 returns to step S107. If M engine cycles have elapsed, then in step S109, the ECU 20 calculates the value of an output fluctuation parameter X2i resulting from execution of the forced active control. A calculation method used in this case is the same as the calculation method in step S104.

Then, in step S110, the ECU 20 determines whether or not the value of i has reached 14 or more. If the value of i has not reached 14 or more, then in step S120, the ECU 20 increments the value of i by 1 and then returns to step S106. Thus, the next pattern allows the value of the output fluctuation parameter X2i to be calculated. In this manner, the ECU 20 consecutively changes one cylinder or two cylinders to be subjected to an increase or a decrease in the amount of injected fuel, and for every change, repeats an increase or a decrease in the amount of injected fuel and calculation of the output fluctuation parameter X2i.

On the other hand, when the value of i has reached 14 or more, this means that the output fluctuation parameter X2i has been calculated for all of the 14 patterns. Thus, the ECU 20 proceeds to step S111.

In step S111, the ECU 20 determines a pattern ix corresponding to the minimum value of the 14 calculated output fluctuation parameters X2i. The minimum value means an output fluctuation parameter that minimizes the degree of a variation in air-fuel ratio.

Then, in step S112, the ECU 20 identifies an abnormal cylinder and the abnormality type of the abnormal cylinder. This identification is carried out using a preset table such as a table shown in FIG. 13.

As shown in FIG. 13, for example, when the determined pattern ix is pattern 1, the #1 cylinder (simply shown as "#1" in FIG. 13) is identified as an abnormal cylinder, and the abnormality type of the #1 cylinder is determined to be an air-fuel ratio lean shift (simply shown as "lean" in FIG. 13).

Furthermore, for example, when the determined pattern ix is pattern 9, the #1 cylinder and the #2 cylinder (simply shown as "#1#2" in FIG. 13) are identified as abnormal cylinders, and the abnormality type of these cylinders is determined to be an air-fuel ratio lean shift, or otherwise, the #3 cylinder and the #4 cylinder (simply shown as "#3#4" in FIG. 13) are identified as abnormal cylinders, and the abnormality type of these cylinders is determined to be an air-fuel ratio rich shift (simply shown as "rich" in FIG. 13).

The pattern involving two abnormal cylinders will be described. Pattern 9 is a pattern in which the amounts of fuel injected for the #1 cylinder and the #2 cylinder are forcibly increased to minimize the value of an output fluctuation parameter X2 as seen in FIG. 12. In this case, the output fluctuation parameter X2 decreases in the following two manners: (1) the inherent lean shifts in the #1 and #2 cylinders are reduced to decrease the value of the output fluctuation parameter X2; or (2) rich shifts occur in the #1 and #2 cylinders so as to conform to the inherent rich shifts in the #3 and #4 cylinders and then the stoichiometric control uniformly reduces the rich shifts in the #1 to #4 cylinders, thus decreasing the value of the output fluctuation parameter X2. Hence, in FIG. 13, pattern 9 means either lean shifts in the #1 and #2 cylinders or rich shifts in the #3 and #4 cylinders.

With reference back to FIGS. 11A and 11B, once the abnormal cylinder and the abnormality type are identified, the ECU 20 proceeds to step S113 to determine whether or not one cylinder is abnormal. In other words, the ECU 20 determines whether the pattern ix determined in step S111 is one of patterns 1 to 8.

If the result of the determination is yes, the ECU 20 proceeds to step S114 to compare the value of an output fluctuation parameter X2ix resulting from execution of the forced active control and calculated in connection with the pattern ix with a predetermined secondary determination value (first secondary determination value) $\alpha 21$. The output fluctuation parameter X2ix corresponds to the minimum output fluctuation parameter.

When $X2ix \geq \alpha 21$, the ECU 20 proceeds to step S115 to make an abnormality determination indicating that variation abnormality is occurring. The ECU 20 thus ends the detection process. On the other hand, when $X2ix < \alpha 21$, the ECU 20 proceeds to step S116 to make a normality determination and then ends the detection process. This secondary determination finally determines whether the engine is normal or abnormal. Upon making an abnormality determination, the ECU 20 activates a warning device such as a check lamp to inform a user of the abnormality. Furthermore, information on the abnormal cylinder and the abnormality type is stored in the ECU 20 for use in subsequent repair stage.

In this case, when the forced active control is performed using the pattern ix, the amount of injected fuel is forcibly changed to eliminate the inherent air-fuel ratio shift in an abnormal cylinder. Thus, the value of the output fluctuation parameter X2ix resulting from the forced active control is normally smaller than the value of the output fluctuation parameter X1 obtained before the execution of the forced active control. Therefore, the secondary determination value $\alpha 21$ is basically set smaller than the primary determination value $\alpha 1$.

If normality is determined in step S116, the abnormal cylinder identified in step S112 is possibly abnormal but is actually not abnormal. Thus, in this case, not only actually abnormal cylinders but also possibly abnormal cylinders are referred to as abnormal cylinders. On the other hand, if abnormality is determined in step S115, the abnormal cylinder identified in step S112 is determined to be actually abnormal. Furthermore, when the forced active control is performed on the abnormal cylinder to reduce the air-fuel ratio shift in the abnormal cylinder, the air-fuel ratio shift can be eliminated to some degree to reduce the value of the output fluctuation parameter. However, when the inherent air-fuel ratio shift in the abnormal cylinder is significant, the shift is precluded from being sufficiently eliminated. Hence, abnormality is determined in step S115. If the pre-catalyst sensor 17 is low in responsiveness, the value of the output fluctuation parameter fails to be significantly reduced even with the forced active control performed on the abnormal cylinder. Also in this case, abnormality is determined in step S115.

On the other hand, if the result of the determination in step S113 is no, two cylinders are abnormal, meaning that the pattern ix determined in step S111 is one of patterns 9 to 14. This case also involves processing similar to the processing carried out when one cylinder is abnormal.

That is, the ECU 20 proceeds to step S117 to compare the value of the output fluctuation parameter X2ix resulting from the execution of the forced active control and calculated in connection with the pattern ix, with a predetermined secondary determination value (second secondary determination value) $\alpha 22$.

The secondary determination value $\alpha 22$ is pre-adapted through experiments or the like to be optimum when two cylinders are abnormal. The secondary determination value $\alpha 22$ is also basically smaller than the primary determination value $\alpha 1$. Furthermore, the secondary determination value $\alpha 22$ is different from the secondary determination value (first secondary determination value) $\alpha 21$ used when one cylinder is abnormal.

When $X2ix \geq \alpha 22$, the ECU 20 proceeds to step S118 to make an abnormality determination to end the detection process. On the other hand, when $X2ix < \alpha 22$, the ECU 20 proceeds to step S119 to make a normality determination to end the detection process. Thus, the ECU 20 finally determines whether the engine is normal or abnormal.

A variation is possible in which steps S113 to S119 are omitted from the detection process illustrated in FIGS. 11A and 11B. That is, without making a two-step determination including a primary determination and a secondary determination or the like as described above, the ECU 20 can finally determine whether the cylinder is normal or abnormal by the determination in step S105. If the result of the determination indicates that the cylinder is abnormal, the ECU 20 can identify the abnormal cylinder in steps S106 to S112. Specifically, when $X1<\alpha 1$ in step S105, the ECU 20 proceeds to step S121 to make a normality determination. On the other hand, when $X1\geq\alpha 1$ in step S105, the ECU 20 makes an abnormality determination in a step not shown in the drawings and subsequently carries out steps S106 to S112.

The preferred embodiment of the present invention has been described in detail. However, various other embodiments are possible. For example, the above-described numerical values are illustrative and can be varied. Furthermore, in some portions of the description, only one of the rich side and the lean side is referred to. However, those skilled in the art will easily understand that the description for one side is applicable to the description for the other side.

When the amounts of fuel injected for two cylinders are changed, the amount of injected fuel is increased as in the case of patterns 9 to 14 according to the present embodiment. However, the amounts of fuel injected for two cylinders may be reduced. Alternatively, the number of patterns may be increased so that the amounts of fuel injected for two cylinders can be sequentially increased and reduced. For example, the amount of injected fuel may be increased in patterns 9 to 14, whereas the amount of injected fuel may be reduced in patterns 15 to 20.

The engine to which the present invention is applied includes any number of cylinders. Furthermore, for a V8 engine, the engine can be configured by applying the configuration of the V4 engine according to the present embodiment to each bank. In this case, the above-described detection process can be applied individually to each bank.

The embodiment of the present invention is not limited to the above-described embodiment. The present invention includes any variations, applications, and equivalents embraced by the concepts of the present invention defined by the claims. Thus, the present invention should not be interpreted in a limited manner but is applicable to any other techniques belonging to the scope of the concepts of the present invention.

What is claimed is:

1. An inter-cylinder air-fuel ratio variation abnormality detection apparatus comprising:

an air-fuel ratio sensor installed in an exhaust passage common to a plurality of cylinders to detect inter-cylinder air-fuel ratio variation abnormality based on a calculated parameter; and an electronic control unit configured to carry out:

(A) a step of forcibly changing amounts of fuel injected for two of the plurality of cylinders and calculating the parameter that correlates with a degree of fluctuation of output from the air-fuel ratio sensor;

(B) a step of changing the two cylinders to two other cylinders and repeating the step (A); and (C) a step of identifying two cylinders causing the inter-cylinder air-fuel ratio variation abnormality based on a plurality of the parameters calculated in the steps (A) and (B).

2. The inter-cylinder air-fuel ratio variation abnormality detection apparatus according to claim 1, wherein the electronic control unit is further configured to identify, in the step (C), two cylinders corresponding to one of the plurality of calculated parameters which minimizes a degree of a variation in air-fuel ratio as two cylinders causing the variation abnormality.

3. The inter-cylinder air-fuel ratio variation abnormality detection apparatus according to claim 1, wherein the electronic control unit is further configured to repeat the step (A) in the step (B) to carry out the change in the amount of injected fuel and the calculation of the parameter for all combinations of two cylinders.

4. The inter-cylinder air-fuel ratio variation abnormality detection apparatus according to claim 1, wherein the electronic control unit is further configured to carry out:

(D) a step of forcibly changing the amount of fuel injected for one of the plurality of cylinders and calculating the parameter; and (E) a step of changing the one cylinder to another cylinder and repeating the step (D), wherein, in step (C), one cylinder or two cylinders causing the variation abnormality are identified based on a plurality of the parameters calculated in steps (A), (B), (D), and (E).

5. The inter-cylinder air-fuel ratio variation abnormality detection apparatus according to claim 1, wherein the electronic control unit is, further configured to also identify a type of the variation abnormality in the step (C).

6. The inter-cylinder air-fuel ratio variation abnormality detection apparatus according to claim 1, wherein, in the step (A), the change in the amount of injected fuel is an increase in the amount of injected fuel.

7. An inter-cylinder air-fuel ratio variation abnormality detection apparatus comprising:

a plurality of fuel injectors that inject an amount of fuel for each of a plurality of cylinders;

an air-fuel ratio sensor installed in an exhaust passage common to the plurality of cylinders to detect inter-cylinder air-fuel ratio variation abnormality based on a calculated parameter; and an electronic control unit operatively connected to the plurality of fuel injectors, the electronic control unit configured to carry out:

(A) a step of controlling two of the plurality of fuel injectors to forcibly changing the amounts of fuel injected for two of the plurality of cylinders and calculating the parameter that correlates with a degree of fluctuation of output from the air-fuel ratio sensor;

(B) a step of changing the two fuel injectors and two cylinders to two other fuel injectors and two other cylinders and repeating the step (A); and (C) a step of identifying two cylinders causing the inter-cylinder air-fuel ratio variation abnormality based on a plurality of the parameters calculated in the steps (A) and (B).

8. The inter-cylinder air-fuel ratio variation abnormality detection apparatus according to claim 7, wherein the electronic control unit is further configured to identify, in the step (C), two cylinders corresponding to one of the plurality of calculated parameters which minimizes a degree of a variation in air-fuel ratio as two cylinders causing the variation abnormality.

9. The inter-cylinder air-fuel ratio variation abnormality detection apparatus according to claim 7, wherein the electronic control unit is further configured to repeat the step (A) in the step (B) to carry out the change in the amount of injected fuel and the calculation of the parameter for all combinations of two cylinders.

10. The inter-cylinder air-fuel ratio variation abnormality detection apparatus according to claim 7, wherein the electronic control unit is further configured to carry out:

(D) a step of controlling one of the plurality of fuel injectors to forcibly changing the amount of fuel injected for one of the plurality of cylinders and calculating the parameter; and (E) a step of changing the one fuel injector and one cylinder to another fuel injector and another cylinder and repeating the step (D), wherein, in step (C), one cylinder or two cylinders causing the variation abnormality are identified based on a plurality of the parameters calculated in steps (A), (B), (D), and (E).

11. The inter-cylinder air-fuel ratio variation abnormality detection apparatus according to claim 7, wherein the electronic control unit is, further configured to also identify a type of the variation abnormality in the step (C).

12. The inter-cylinder air-fuel ratio variation abnormality detection apparatus according to claim 7, wherein, in the step (A), the change in the amount of injected fuel is an increase in the amount of injected fuel.

* * * * *